US005671860A

United States Patent [19]

Louwerse et al.

[11] Patent Number: 5,671,860

[45] Date of Patent: Sep. 30, 1997

[54] FULL-APERTURE EASY-OPEN METAL CAN-END

[75] Inventors: Gerard M. Louwerse, Velserbroek; Eelco A. Stevens, Heerhugowaard, both of Netherlands

[73] Assignee: Hoogovens Staal, B.V., Ijmuiden, Netherlands

[21] Appl. No.: 325,103

[22] Filed: Oct. 17, 1994

[30] Foreign Application Priority Data

Oct. 20, 1993 [NL] Netherlands ..... 9301812

[51] Int. Cl.[6] ..... B65D 17/34

[52] U.S. Cl. ..... 220/276; 220/273

[58] Field of Search ..... 220/608, 623, 220/273, 276, 604, 609; 413/4, 26, 56, 62

[56] References Cited

U.S. PATENT DOCUMENTS

| | | | |
|---|---|---|---|
| 2,971,671 | 2/1961 | Shakman | 220/609 X |
| 3,450,300 | 6/1969 | Saunders . | |
| 3,674,171 | 7/1972 | Fahlbusch | 220/623 X |
| 3,720,349 | 3/1973 | Brown | 220/273 |
| 3,902,626 | 9/1975 | Jordan et al. | 220/266 X |
| 3,941,277 | 3/1976 | McKinney et al. . | |
| 3,954,075 | 5/1976 | Jordan | 220/266 |
| 4,042,144 | 8/1977 | Henning et al. | 220/273 |
| 4,249,666 | 2/1981 | Hubert et al. | 220/608 X |
| 4,399,925 | 8/1983 | Fundom | 220/273 X |
| 4,445,621 | 5/1984 | Saunders | 220/273 |
| 4,533,064 | 8/1985 | Kawamata et al. | 220/273 |
| 4,762,245 | 8/1988 | Matsubayashi et al. | 220/269 |
| 5,038,956 | 8/1991 | Saunders | 220/273 X |

FOREIGN PATENT DOCUMENTS

| | | |
|---|---|---|
| 319795 | 4/1920 | Germany . |
| 2260375 | 6/1974 | Germany . |
| 2611998 | 9/1977 | Germany . |
| 6815763 | 7/1969 | Netherlands . |

OTHER PUBLICATIONS

"INTERPACH 78" Dusseldorf 78, Brochure Webra. English–language translation attached.

*Primary Examiner*—Allan N. Shoap
*Assistant Examiner*—Robin A. Hylton
*Attorney, Agent, or Firm*—Watson Cole Stevens Davis, P.L.L.C.

[57] ABSTRACT

Full-aperture easy-open metal can-end for a can of the lift-up type with a tab, having an endless score-line close to its outer circumference of the can-end, wherein the removable part is profiled with a plurality of terraces at different heights, including an outer terrace close to the outer circumference of the can-end, an innermost terrace and at least one intermediate terrace. Adjacent terraces merge into one another with a height transition. To achieve low tear-force and/or other advantages, the intermediate terrace is inclined in a direction opposite to that of the outwardly adjoining transition at an angle $\alpha$ in the range 3 to 20 degrees to a plane perpendicular to the can axis.

20 Claims, 3 Drawing Sheets

FULL-APERTURE EASY-OPEN METAL CAN-END

BACKGROUND OF THE INVENTION

1. Field of the Invention

The invention relates to a metal full-aperture easy-open metal can-end, intended for a can of the lift-up type which is opened by lifting and pulling of a tab attached to the can-end, the can-end having an endless score-line close to its outer circumference. The removable region within the score-line of the can-end is profiled with a shape in order to control the opening forces.

2. Description of the Prior Art

A can-end of this type with a profiled shape comprising flat terraces and short transitions between terraces is known, and is made from steel or aluminium. The forces needed for opening form an important property of such a can-end.

The can with a can-end of the type in question is opened in stages. First the lift-up action of the tab makes a crack locally in the score-line. The force needed for this is called the pop-force. Next the can-end is further cracked open with the tab. The maximum force needed for this is called the tear-force. Finally the can-end is pulled away from the can. The force needed for this is called the tear-off force. In the case of an aluminium can-end the pop-force is as a rule 20N and the tear-force is as a rule 40N.

Up to now such a can-end when made from steel has had the inconvenience that the forces needed for opening the can are usually greater than the forces for opening an aluminium can-end, and at best, in the case of the known ELOE can-end (Easy Opening Little Effort), these forces are equal to the above-mentioned opening forces of an aluminium can-end. However, a wholly steel can is very attractive from the environmental standpoint.

In relation to the present invention, attention is drawn to U.S. Pat. No. 3,941,277 which in FIGS. 12 and 13 shows a can-end in which the removable portion has a profiled shape with three flat terraces at different height positions and, between the outermost flat terrace and the next terrace, a deep and wide groove and a slight ridge. The inner face of this groove may be regarded as a steeply sloping additional terrace.

SUMMARY OF THE INVENTION

An object of the invention is to provide a can-end, especially a steel can-end, with opening forces which are low, especially are lower than, or not greater than, the above-mentioned forces for opening an aluminium can-end.

A further object of the present invention at least in some embodiments, is to provide a can end with which the maximum tear force occurs with a relatively small tab displacement.

In accordance with the invention there is provided a full-aperture easy-open metal can-end for a can of the type which is opened by lifting and pulling of a tab attached to the can-end, the can-end having a can-end wall bounded by an outer circumference, and an endless score-line extending close to the outer circumference and defining a removable region of the can-end wall which is removed on opening. The removable region has a profiled shape providing a plurality of terraces which are at different height positions with respect to the longitudinal can axis (i.e. the axis of a can to which the can-end is attached in use). There is a height transition zone respectively connecting each adjacent pair of the terraces. The terraces comprise a flat outer terrace extending adjacent the score-line along at least part of the length of said score-line, an innermost terrace which is located more centrally in the can-end relative to the outer terrace and at least one intermediate terrace which is located between the outer terrace and the innermost terrace and has an inclination at an inclination angle in the range 3° to 20° to a plane perpendicular to the can axis. This inclination is in a direction opposite to a direction of the transition zone connecting the intermediate terrace to the next adjacent one of the terraces outwardly thereof. Thus when, as is preferred, this transition is downward (towards the can interior where the can-end is attached to a can), the inclination of the terrace is upward.

Preferably the inclination angle is not more than 15°, and also preferably the inclination angle is not less than 5°, to provide the defined low tear force. About 10° has been found especially suitable for low tear force.

The can-end preferably has three terraces, consisting of the outer terrace, the innermost terrace and only one intermediate terrace. In one alternative, there are two intermediate terraces. The intermediate terrace having the inclination is preferably adjacent to the innermost terrace, or may be adjacent to the outer terrace or both.

Preferably the innermost terrace is flat and has the lowest height position among the terraces.

To provide low opening forces, it is preferred that the transition zones are gradual, rather than sharp. Thus preferably at least the transition zone connecting the intermediate terrace having the inclination to the next adjacent terrace outwardly thereof has, as seen in radial section with respect to the can axis, an inclined portion which extends at least 1.5 mm, preferably at least 2.0 mm, more preferably at least 2.5 mm. Preferably also this transition zone has curved portions joining this inclined portion respectively to the two adjacent terraces, with the radius of curvature of each curved portion being at least 1.0 mm.

Preferably also, at least the transition zone connecting the intermediate terrace having the inclination to the next adjacent terrace outwardly thereof has, as seen in radial section with respect to the can axis, an inclined portion which has an inclination angle to a plane perpendicular to the can axis which is at least twice the inclination angle of the intermediate terrace.

For appropriate stiffness and opening forces, preferably the difference of the height positions of the outer terrace and the innermost terrace is at least 2 mm.

Although the can-end in accordance with the invention may be made from aluminium, the can-end is preferably made from steel. An entirely steel can is excellent for recycling. More preferably the steel can-end is made from continuously annealed steel, type temper 61 (T61 CA). In this case the opening forces are extra low. In the case of one steel can-end in accordance with the invention the pop-force is, for example, 17N and the tear-force 31N.

The residual thickness of the can-end in the area of the score-line is preferably 50 to 75 μm and more preferably 55 to 65 μm. With this the lowest opening forces are obtained. In the case of smaller residual thicknesses the resistance to internal pressure in the can may be too low and in the case of greater residual thicknesses the opening forces may be too great.

To obtain a low tear force, it is preferred that the width of the score-line is at least 0.03 mm.

Although the can-end in accordance with the invention may also be used for can sizes 65, 83 and 99 mm, the can-end is preferably used for can size 73 mm. The can-end in accordance with the invention is well suited to this can size.

INTRODUCTION TO THE DRAWINGS

Other details and features of the invention will stand out from the description given below by way of non-limitative example and with reference to the accompanying drawings, in which.

FIGS. 5, 6, 7 and 8 show in partial radial section, the design of the can-ends 3, 4, 5 and 6 of Table 1.

DESCRIPTION OF THE PREFERRED EMBODIMENTS

Figure 1:
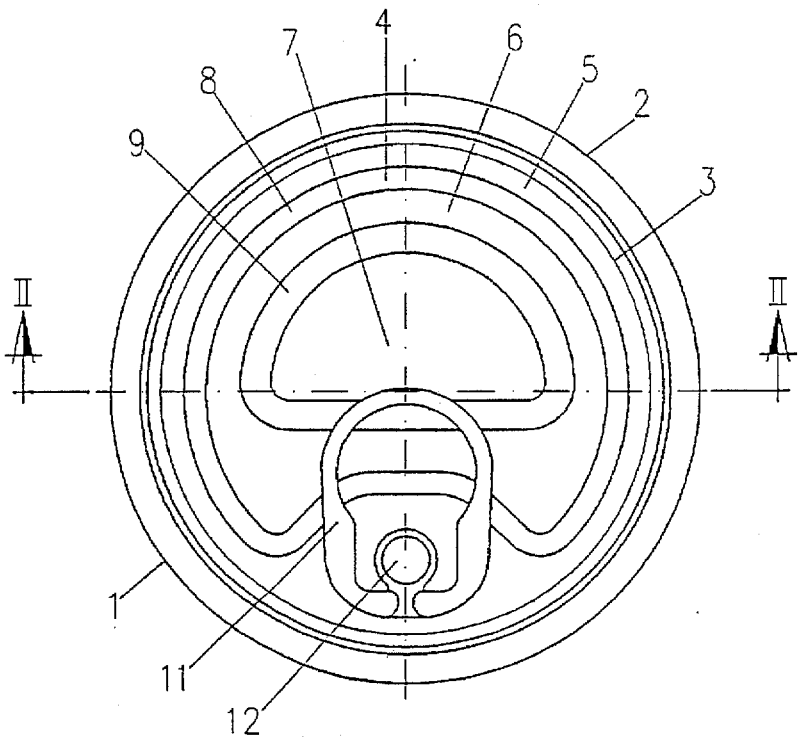
FIG. 1 shows a top view of an example of a can-end in accordance with the invention.
Figure 2:
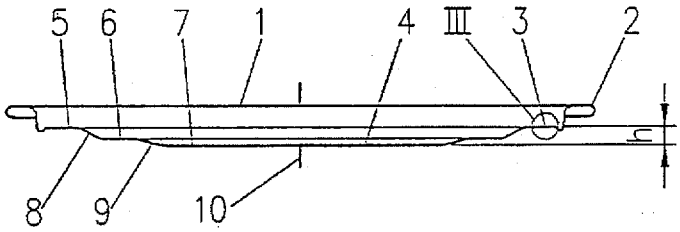
FIG. 2 shows a cross-section of the can-end according to line II—II in FIG. 1.
Figure 3:
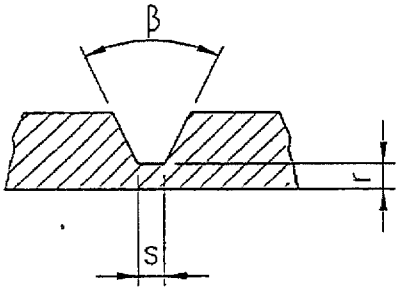
FIG. 3 shows in detail the score in the can-end indicated by III in FIG. 2.

In FIGS. 1, 2 and 3 the can-end 1 has an endless score-line 3 placed close to the outer circumference 2. On the inside of the score is the region 4 of the can-end to be removed. In the example shown the can-end has three terraces 5, 6 and 7 of which the flat first terrace 5 lies alongside the score-line 3 and is situated close to the outer circumference 2, and of which the intermediate second terrace 6 and the third flat centre terrace 7 are situated further from the outer circumference 2. In accordance with the invention the intermediate terrace 6 is inclined at an angle $\alpha$ of more than 3 degrees relative to a plane perpendicular to the can axis 10. In the example, shown there are height transitions 8 and 9 between the terraces, being a transition 8 from terrace 5 towards terrace 6, and a transition 9 from terrace 6 towards terrace 7. At least the transition 8 is gradual and extends over a radial distance of over 1.5 mm. In the example shown the second terrace 6 is lower than the first terrace 5. However it is within the scope of the invention that at least the second terrace 6 is higher than terrace 5.

In the can-end 1 shown in FIG. 1 for a round can the terraces 5, 6 and 7 are part-circular. The outer terrace 5 is widened over a small part of the circumference to permit attachment of the tab 11 to the can-end, for example by a rivet 12. The tab 11 and rivet 12 are conventional and need not be described further.

In the case of the can-end of the type in question, it is usual for the innermost terrace, terrace 7 in FIG. 1, to be lower than the first terrace 5. This achieves the effect that the tab 11 can be gripped easily. It has been found that extra low opening forces are obtained if the difference in height h between the first terrace 5 and the last terrace 7 is greater than 2 mm.

In FIG. 3 a detail of the score is shown. This has an apex angle $\beta$ of, for example, 70 degrees, a score width s of more than 0.03 mm and a residual thickness r of 50 μm minimum.

Figure 4:
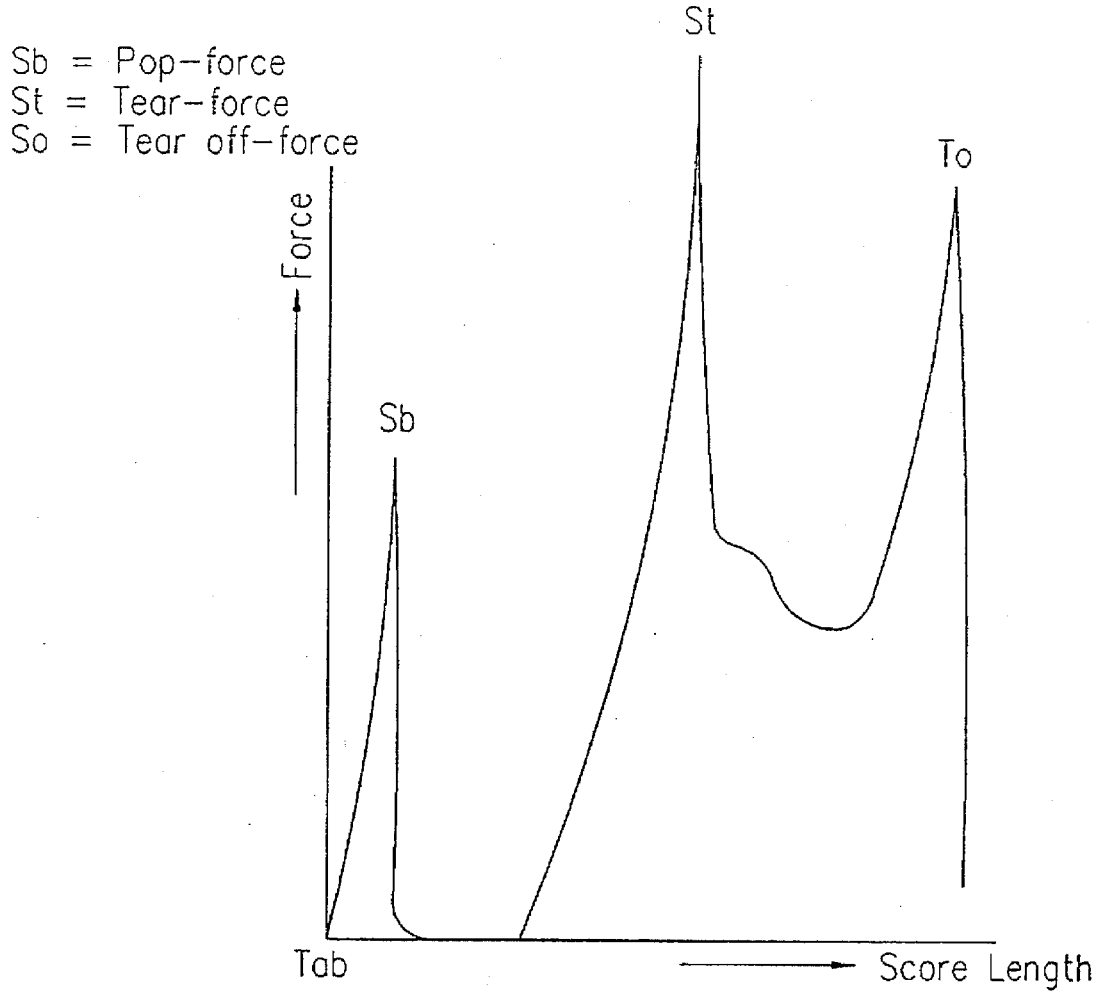
FIG. 4 shows schematically a typical opening characteristic of a can-end in accordance with the invention.
Figure 5:
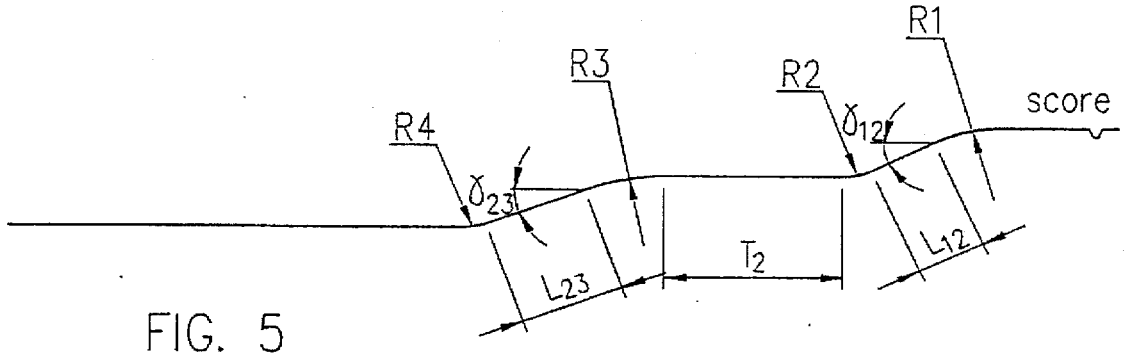
Figure 6:
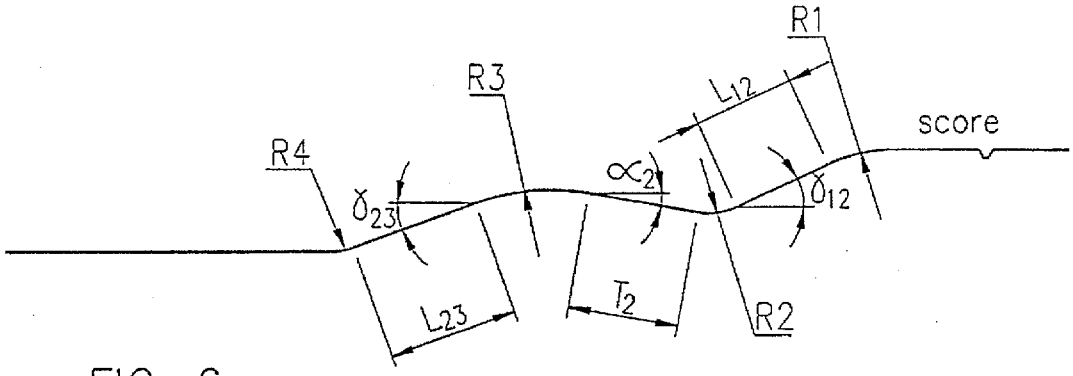
Figure 7:
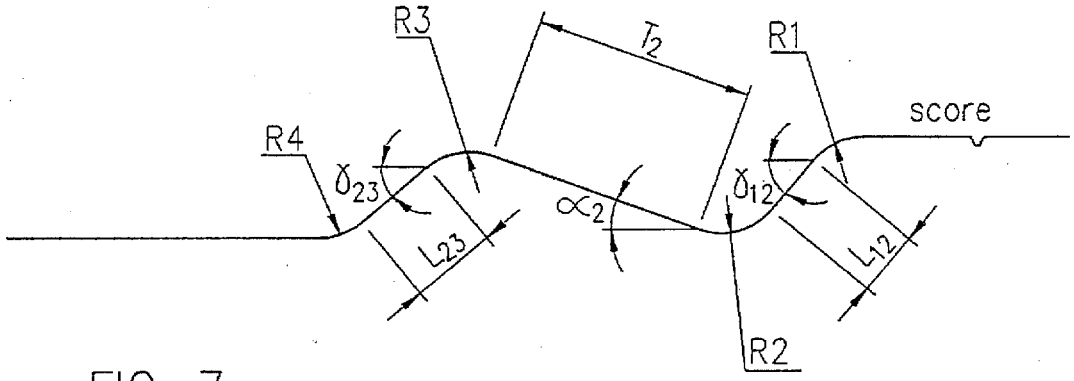
Figure 8:
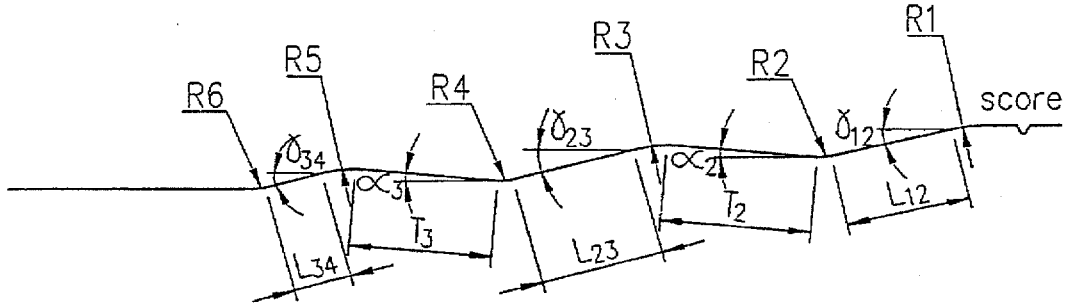

FIG. 4 shows the trend of forces along the score on opening. First of all a so-called pop-force Sb is needed for making a crack in the score 3. On further opening the force then reaches a maximum, the so-called tear-force St and for pulling loose the can-end the so-called tear-off force To is then needed. These forces are decisive for the ease of opening.

EXAMPLES

For a number of steel can-ends designed for can size 73 mm with specifications 1–9 according to table 1 below, the tear-force was determined. Common characteristics of the can-ends are:

sheet thickness of steel can-ends: 0.24 mm score angle $\beta$ (see FIG. 3): 70° score width S (see FIG. 3): 0.111 mm

All can-ends of Table 1 are of steel, except no. 10 which is aluminium. Can-end nos. 4, 5 and 6 are examples of the present invention while the remainder are comparative, to illustrate the effects on which the invention is based. Only can-end nos. 10 and 11 can be regarded as prior art.

TABLE 1

| No. | Specifications | Angle $\alpha_2$ | Material | Residual thickness | Tear-force |
|---|---|---|---|---|---|
| 1 | Completely flat can-end | 0° | St T61 CA | 60 μm | 38N |
| 2 | Can-end with 3 flat terraces and short transitions | 0° | St T61 CA | 60 μm | 60N |
| 3 | Can-end with 3 flat terraces. Specification see table 2 and FIG. 5 | 0° | St T61 CA | 60 μm | 35N |
| 4 | Can-end with 3 terraces; terrace 1 and 3 flat, terrace 2 inclined. Specification see table 2 and FIG. 6 | 10° | St T61 CA | 60 μm | 31N |
| 5 | Can-end with 3 terraces; terrace 1 and 3 flat, terrace 2 inclined. Specification see table 2 and FIG. 7 | 20° | St T61 CA | 60 μm | 44N |
| 6 | Can-end with 4 terraces; terrace 1 and 4 flat, terrace 2 and 3 inclined. Specification see table 2 and FIG. 8 | 5° | St T61 CA | 60 μm | 39N |
| 7 | Completely flat can-end (Compare no. 1) | 0° | St T61 CA | 50 μm | 29N |
| 8 | Completely flat can-end (Compare no. 1) | 0° | St T61 CA | 70 μm | 44N |
| 9 | Completely flat can-end (Compare no. 1) | 0° | St T57 BA | 60 μm | 42N |
| 10 | Can-end with 3 flat terraces and short transitions | 0° | Al | NN | 40N |
| 11 | EOLE can-end with 3 flat terraces with short transitions | 0° | St NN | NN | 40N |

(NN = not known)

Can-ends nos. 2, 10 and 11 have short transitions between the terraces of usually less than 1 mm, but in all cases less than 1.5 mm.

The design of can-ends nos. 3, 4, 5 and 6 is specified in Table 2 and in FIGS. 5, 6, 7 and 8.

TABLE 2

| | No. 3 (FIG. 5) | No. 4 (FIG. 6) | No. 5 (FIG. 7) | No. 6 (FIG. 8) |
|---|---|---|---|---|
| $R_1$ (mm) | 3.5 | 3.5 | 1.5 | 3.0 |
| $R_2$ (mm) | 1.5 | 1.5 | 1.5 | 1.0 |
| $R_3$ (mm) | 5.0 | 5.0 | 1.5 | 3.0 |
| $R_4$ (mm) | 1.5 | 1.5 | 1.5 | 1.0 |
| $R_5$ (mm) | — | — | — | 3.0 |
| $R_6$ (mm) | — | — | — | 1.0 |
| $L_{12}$ (mm) | 1.5 | 2.3 | 1.5 | 2.85 |
| $T_2$ (mm) | 4.0 | 2.5 | 5.0 | 3.45 |
| $L_{23}$ (mm) | 2.3 | 3.0 | 2.0 | 2.8 |
| $T_3$ (mm) | — | — | — | 3.3 |
| $L_{14}$ (mm) | — | — | — | 1.35 |
| $\gamma_{12}$ | 25° | 25° | 50° | 13° |
| $\alpha_2$ | 0° | 10° | 20° | 5° |
| $\gamma_{23}$ | 20° | 20° | 40° | 15° |
| $\alpha_3$ | — | — | — | 5° |
| $\gamma_{34}$ | — | — | — | 15° |
| h (mm) | 2.5 | 2.3 | 2.3 | 1.4 |

In table 2:

$R_1$–$R_6$=radius of curvature as indicated in FIGS. 5, 6, 7 and 8;

$L_{12}$, $L_{23}$ and $L_{34}$=length of the transition between the first and second, second and third, third and fourth terraces respectively as indicated in FIGS. 5, 6, 7 and 8;

$T_2$, $T_3$=length of the second and third terraces respectively as indicated in FIGS. 5, 6, 7 and 8;

$\gamma_{12}$, $\gamma_{23}$, and $\gamma_{34}$=angle of inclination of the transition between the first and second, second and third, third and fourth terraces respectively as indicated in FIGS. 5, 6, 7 and 8;

$\alpha_2$, $\alpha_3$=angle of inclination of the second and third terraces respectively as indicated in FIGS. 5, 6, 7 and 8;

h=difference in height between the first and last terraces.

Can-end no. 1 in table 1 is a completely flat can-end and has a tear-force of 40N. Although it has a low tear-force, a completely flat can-end is not acceptable because of the risk of premature opening (pre-opening) as a consequence of internal pressure (the can-end must be resistant to an internal pressure of 3 bars) and/or handling. Premature opening may be avoided by designing the can-end with terraces.

Can-end no. 2 has three flat terraces and short transitions and has a tear-force of 60N.

Can-ends nos. 10 and 11 are known can-ends likewise with three flat terraces and short transitions. Can-end no. 10 is of aluminium and has a tear-force of 40N. In the case of steel the EOLE can-end no. 11 with its low opening forces, the tear-force is likewise 40N.

Can-ends nos. 3, 4, 5 and 6 have gradual transitions between the terraces of radial length 1.5 mm or more.

Table 1 shows that can-end no. 3 with three flat terraces and gradual transitions has a lower tear-force than can-end no. 11.

However, can-end no. 4 with three terraces of which the second terrace inclines at an angle of 10 degrees and with gradual transitions has an even lower tear-force.

However, can-end no. 5 with three terraces of which the second terrace inclines at an angle of 20 degrees has a considerably higher tear-force than can-end no. 4.

Can-end no. 6 with four terraces of which the second and third terraces incline at 5 degrees has a higher tear-force than can-end no. 4 but this could probably be lowered further by increasing the angle of inclination somewhat; in the case of can-end no. 6 the maximum tear-force occurs with a smaller tab displacement; consequently in this respect the 4-terrace can-end (no. 6) is rather more user-friendly than the 3-terrace can-end.

Comparing can-end nos. 1, 7 and 8 shows that the tear-force strongly depends on the residual thickness of the score.

Can-end no. 9 is made from batch annealed steel, temper 57 (T57 BA). This and other trials showed that T61 CA steel gives the lowest opening forces.

The invention has been illustrated by these Examples and embodiments, but is not limited thereto, and modifications and variations within the concept of the invention are possible.

What is claimed is:

1. A full-aperture easy-open metal can-end with low opening forces for a can of the type which is opened by lifting and pulling of a tab attached to the can-end, said can-end having a) a can-end wall bounded by an outer circumference, and b) an endless score-line extending close to the outer circumference and defining a removable region of the can-end wall which is removed on opening, c) said removable region of said can-end wall having a profiled shape providing a plurality of terraces which are at different height positions with respect to the longitudinal can axis, and a plurality of inclined transition zones respectively between and connecting pairs of said terraces, said terraces comprising a flat outer terrace extending adjacent said score-line along at least part of the length of said score-line, an innermost terrace which is located more centrally in the can-end relative to said outer terrace and at least one intermediate terrace which is located between said outer terrace and said innermost terrace and has an inclination at an inclination angle in the range 3° to 20° to a plane perpendicular to the can axis, said inclination being in the direction opposite to a direction of inclination said inclined transition zone connecting said intermediate terrace to the next adjacent one of said terraces outwardly thereof.

2. A can-end according to claim 1 wherein said inclination angle is not more than 15°.

3. A can-end according to claim 1 wherein said inclination angle is not less than 5°.

4. A can-end according to claim 1 wherein said inclination angle is about 10°.

5. A can-end according to claim 1 having three said terraces, consisting of said outer terrace, said innermost terrace and only one said intermediate terrace.

6. A can-end according to claim 1 wherein said intermediate terrace having said inclination is adjacent to said innermost terrace.

7. A can-end according to claim 1 wherein said innermost terrace is flat and has the lowest height position among said terraces.

8. A can-end according to claim 1 wherein said intermediate terrace having said inclination is adjacent to said outer terrace.

9. A can-end according to claim 1 wherein at least said transition zone connecting said intermediate terrace having said inclination to said next adjacent terrace outwardly thereof has, as seen in radial section with respect to the can axis, an inclined portion which extends at least 1.5 mm and curved portions joining said inclined portion respectively to the two adjacent said terraces, the radius of curvature of each said curved portion being at least 1.0 mm.

10. A can-end according to claim 1 wherein at least said transition zone connecting said intermediate terrace having said inclination to said next adjacent terrace outwardly thereof has, as seen in radial section with respect to the can axis, an inclined portion which extends at least 1.5 mm.

11. A can-end according to claim 1 wherein at least said transition zone connecting said intermediate terrace having said inclination to the next adjacent terrace outwardly thereof has, as seen in radial section with respect to the can axis, an inclined portion which has an inclination angle to a plane perpendicular to the can axis which is at least twice said inclination angle of said intermediate terrace.

12. A can-end according to claim 11 wherein said intermediate terrace having said inclination has a greater length, as seen in radial section with respect to the can-axis, than said inclined portion of said transition zone.

13. A can-end according to claim 1 wherein the difference of said height positions of said outer terrace and said innermost terrace is at least 2 mm.

14. A can-end according to claim 1 which is made from steel.

15. A can-end according to claim 14 which is made from continuously annealed steel of type temper 61 (T61 CA).

16. A can-end according to claim 1 wherein the residual thickness of said score-line is in the range 50 to 75 μm.

17. A can-end according to claim 16 in which said residual thickness is in the range of 55 to 65 μm.

18. A can-end according to claim 1 in which the width of said score-line is at least 0.03 mm.

19. A can-end according to claim 1 fittable to a can size of 73 mm diameter.

20. A can having a can-end according to claim 1, which can-end has an opening tab attached thereto.

* * * * *